US010118419B2

(12) United States Patent
Kikui et al.

(10) Patent No.: US 10,118,419 B2
(45) Date of Patent: Nov. 6, 2018

(54) SHEET DETECTION DEVICE AND PRINTER

(71) Applicant: CITIZEN WATCH CO., LTD., Tokyo (JP)

(72) Inventors: Takehiro Kikui, Tokyo (JP); Takuro Kohyama, Tokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/640,857

(22) Filed: Jul. 3, 2017

(65) Prior Publication Data

US 2018/0001677 A1 Jan. 4, 2018

(30) Foreign Application Priority Data

Jul. 4, 2016 (JP) ..... 2016-132474

(51) Int. Cl.

| | |
|---|---|
| ***B41J 13/00*** | (2006.01) |
| ***B41J 13/10*** | (2006.01) |
| ***B41J 3/407*** | (2006.01) |
| ***B41J 11/00*** | (2006.01) |
| ***B41J 11/46*** | (2006.01) |
| ***B41J 15/04*** | (2006.01) |

(52) U.S. Cl.

CPC ..... *B41J 13/0009* (2013.01); *B41J 3/4075* (2013.01); *B41J 11/0095* (2013.01); *B41J 11/46* (2013.01); *B41J 13/10* (2013.01); *B41J 15/046* (2013.01)

(58) Field of Classification Search

CPC ..... B41J 13/0009; B41J 13/10; B41J 13/00; B41J 15/00; B41J 15/04; B41J 15/044; B41J 15/046; B41J 11/58; B41J 15/02; B41J 3/4075

See application file for complete search history.

(56) References Cited

U.S. PATENT DOCUMENTS

| | | |
|---|---|---|
| 2012/0188547 A1 | 7/2012 | Matsushima |
| 2013/0141487 A1 | 6/2013 | Abe |

FOREIGN PATENT DOCUMENTS

| | | |
|---|---|---|
| JP | 63-63452 | 4/1988 |
| JP | 3-102547 | 10/1991 |
| JP | 2003-146482 | 5/2003 |
| JP | 2012-148884 | 8/2012 |

*Primary Examiner* — Kristal Feggins

(74) *Attorney, Agent, or Firm* — Wenderoth, Lind & Ponack, L.L.P.

(57) ABSTRACT

A sheet detection device includes a sheet guide between a sheet feeding opening into which a sheet is to be inserted and a printing mechanism for printing on the sheet, the sheet guide including a guide surface through which the sheet is to pass, a sheet detector including an optical sensor configured to detect a predetermined position of the sheet, an opening defined in the guide surface, the sheet detector being inside the opening and the optical sensor being exposed through the opening, and a transparent guide cover configured in the guide surface to cover at least a first border position between the sheet detector and the opening on an upstream side in a sheet transport direction.

6 Claims, 9 Drawing Sheets

SHEET DETECTION DEVICE AND PRINTER

CROSS-REFERENCE TO RELATED APPLICATION

The present application is based on and claims priority to Japanese patent application No. 2016-132474, filed Jul. 4, 2016, the disclosure of which is hereby incorporated by reference herein in its entirety.

BACKGROUND

Technical Field

The present invention relates to a sheet detection device and a printer including the sheet detection device. The sheet detection device includes a sheet guide having a guide surface through which a sheet passes. The guide surface is provided with an opening through which an optical sensor as a sheet detector is exposed.

Description of Related Art

Conventionally, printers that print on label paper in which labels are stuck on roll long mount paper at predetermined intervals or on tag paper in which tags are continuously formed on accordion-fold long paper has been known. As these printers are required to print on paper such as label paper or tag paper in a predetermined position, a sheet detection device that detects a predetermined position of paper is installed in the printers. A sheet detection device including a sheet guide disposed between a sheet feeding opening into which a sheet is inserted and a printing mechanism that prints on a sheet has been taught by JP2012-148884A, JP2003-146482A, JP H03-102547U1, and JP S63-063452U1. This sheet guide includes a guide surface provided with an opening through which an optical sensor as a sheet detector is exposed.

In the conventional sheet detection device, the guide surface of the sheet guide is covered by an openable and closable cover. When a sheet is inserted from the sheet feeding opening toward the printing mechanism with the cover being closed, the sheet may be caught by an end portion of the opening provided in the guide surface or by the sheet detector.

SUMMARY

The present invention has been made in view of the above problem. An object of the present invention is to provide a sheet detection device and a printer in which a sheet inserted from a sheet feeding opening smoothly reaches a printing mechanism without being caught on the way to the printing mechanism with the cover being closed.

To achieve the above object, an aspect of the present invention provides a sheet detection device including a sheet guide disposed between a sheet feeding opening into which a sheet is inserted and a printing mechanism of printing on the sheet, the sheet guide including a guide surface through which the sheet passes, a sheet detector including an optical sensor that detects a predetermined position of the sheet, an opening formed in the guide surface, the sheet detector being disposed inside the opening and the optical sensor being exposed through the opening, and a transparent guide cover provided in the guide surface to cover at least a first border position between the sheet detector and the opening on an upstream side in a sheet transport direction.

DETAILED DESCRIPTION

Hereinafter, a sheet detection device and a printer according to a preferred embodiment of the present invention are described with reference to an Embodiment and the drawings.

Embodiment

The configurations of the sheet detection device and the printer according to the Embodiment are separately described under the headings of "Entire Configuration of Printer" and "Detailed Configuration of Sheet Detection Device".

Entire Configuration of Printer

Figure 1:
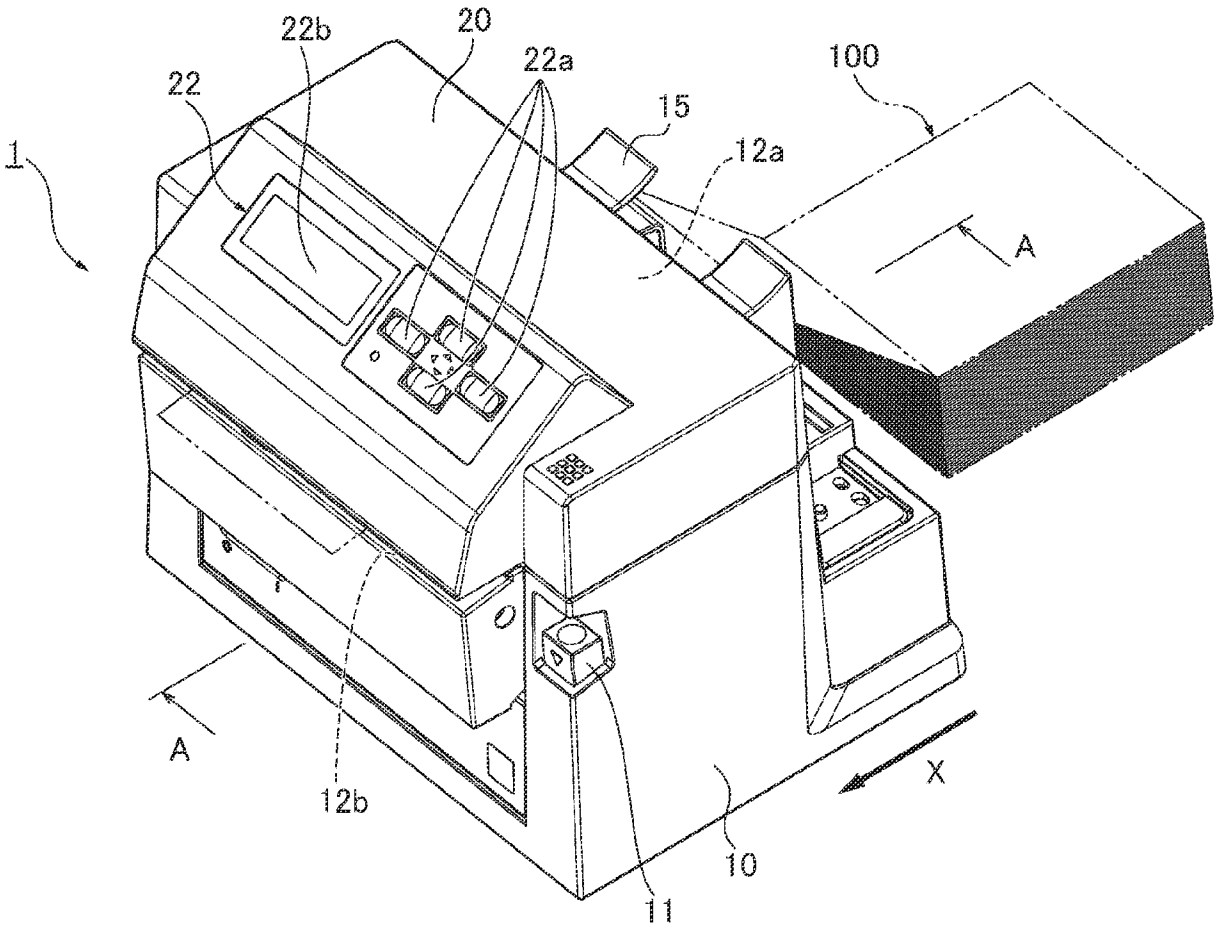
FIG. 1 is a perspective view of a usage state of a printer with a cover being closed according to an Embodiment.
Figure 2:
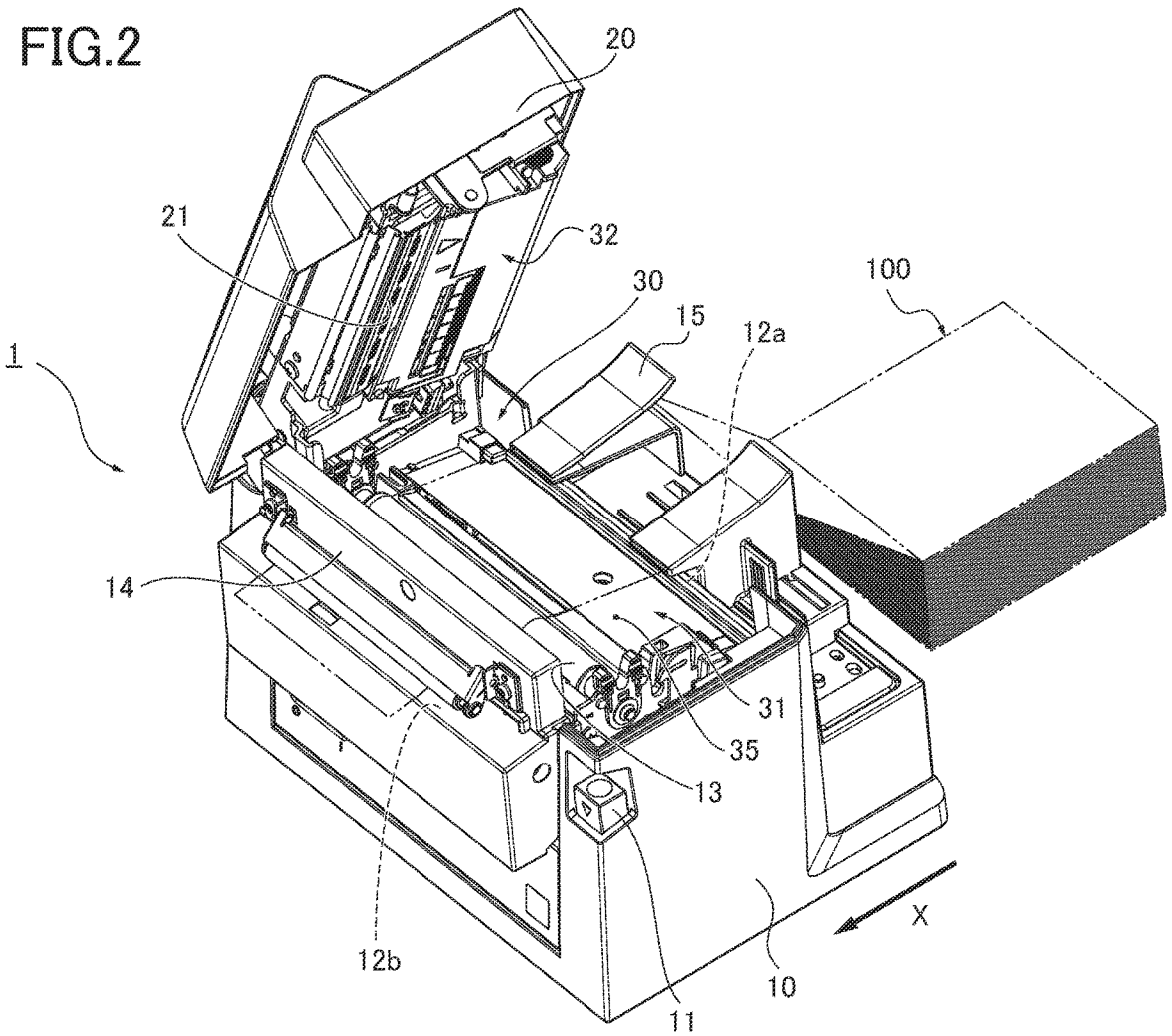
FIG. 2 is a perspective view of the printer with the cover being open according to the Embodiment.
Figure 3:
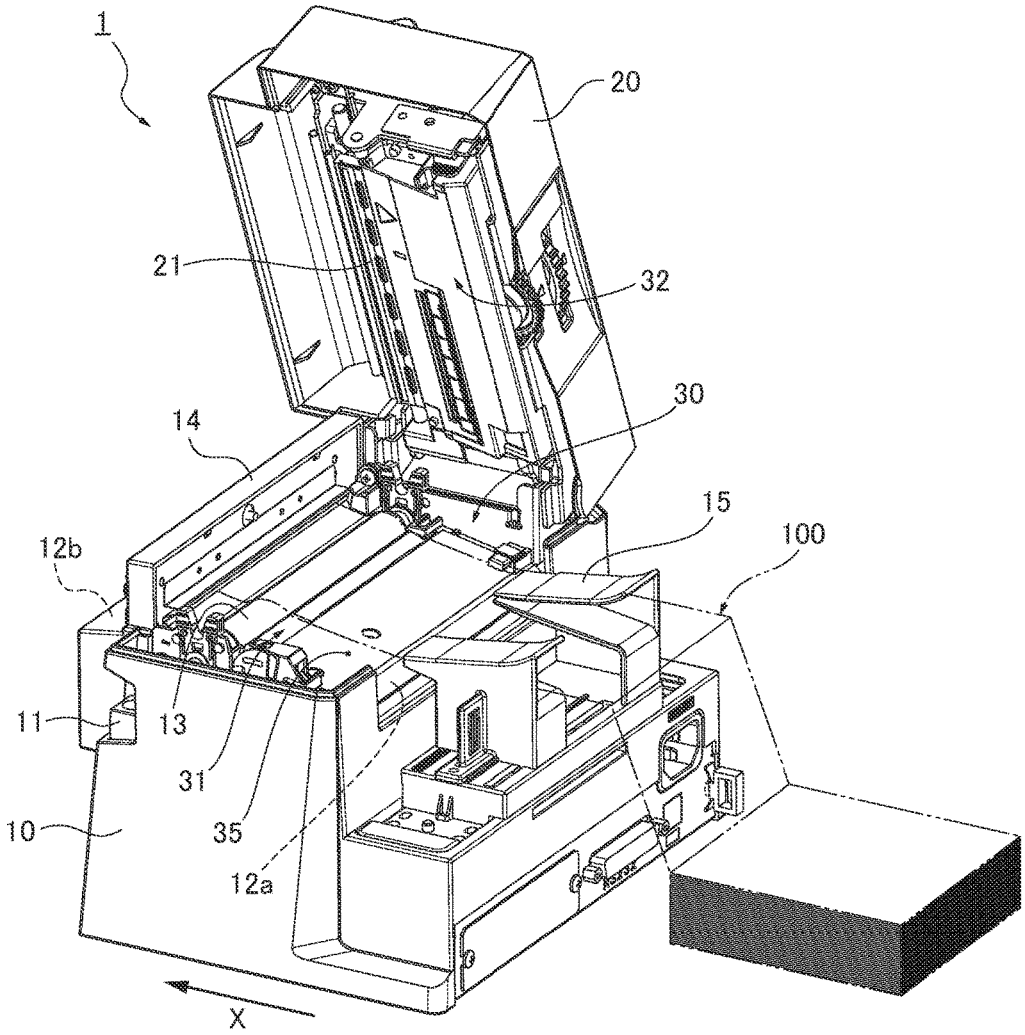
FIG. 3 is a perspective view of the printer with the cover being open according to the Embodiment as seen the printer at an angle different from that in FIG. 2.
Figure 4:
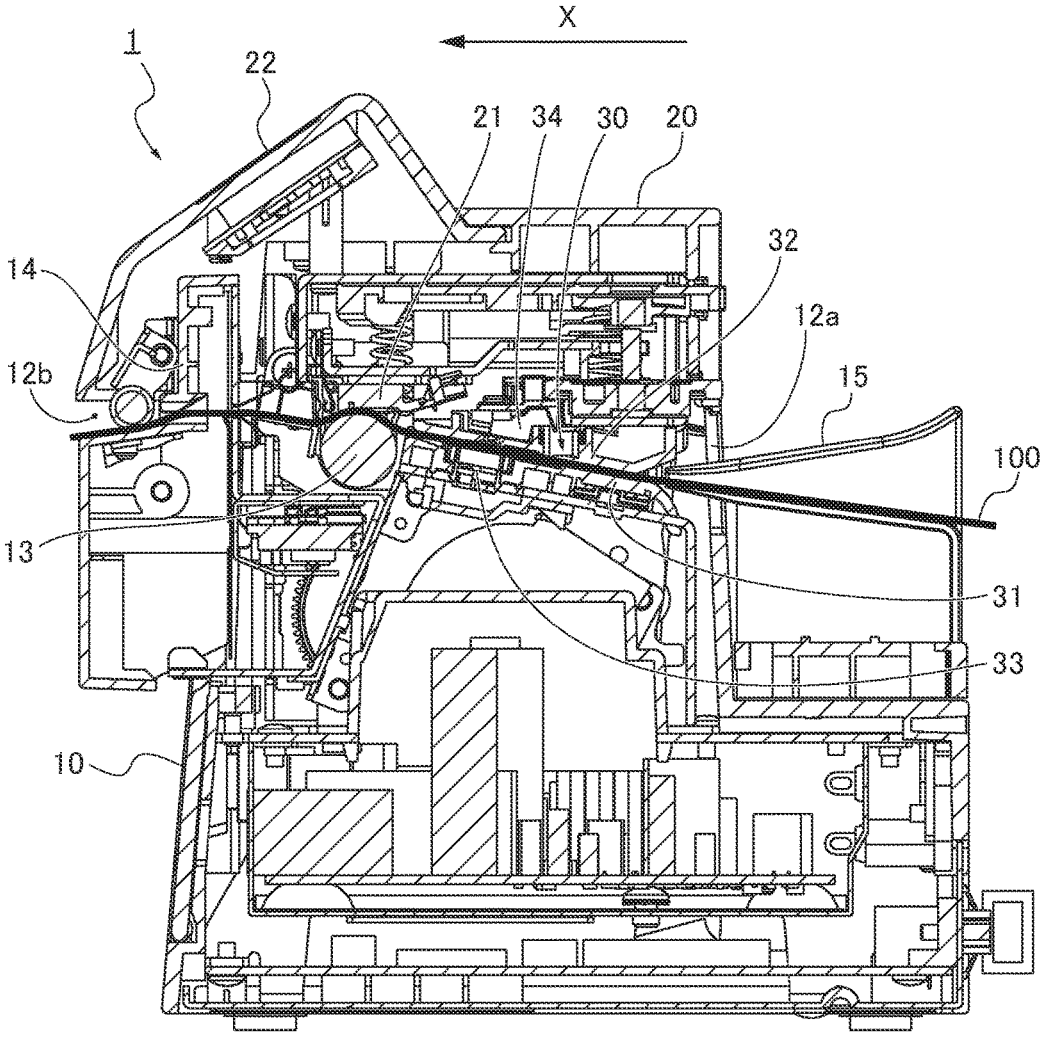
FIG. 4 is a sectional view along an A-A line in FIG. 1 of the printer according to the Embodiment.

FIGS. 1 to 3 are perspective views of a printer according to the Embodiment. FIG. 4 is a sectional view along an A-A line in FIG. 1. The entire configurations of the printer according to the Embodiment are described with reference to FIGS. 1 to 4.

A printer 1 according to the Embodiment is a thermal printer that prints with a printing method (thermal method) of inducing chemical reaction by heating a sheet 100 in which special drug is applied on a printing surface with a thermal head 21 for coloring. This printer 1 includes a main body 10 and a cover 20 that covers a top portion of the main body 10. The cover 20 laterally rotates as illustrated in FIGS. 2 and 3 by pressing an opening and closing button 11 provided in the main body 10.

This printer 1 is used with the cover 20 being closed. As illustrated in FIG. 4, the sheet 100 is fed from a sheet feeding opening 12*a* formed in the border between the main body 10 and the cover 20. After the sheet 100 is printed in a region covered by the cover 20, the printed sheet 100 is discharged from a sheet discharging opening 12*b* formed in the border between the main body 10 and the cover 20. A direction from the sheet feeding opening 12*a* to the sheet discharging opening 12*b* is defined as a sheet transport direction X.

"Upstream side in sheet transport direction X" is defined as a side closer to the sheet feeding opening 12*a* and "downstream side in sheet transport direction X" is defined as a side closer to the sheet discharging opening 12*b*. In addition, the maintenance of the printer 1 such as checking or exchanging of components disposed in the main body 10 and the cover 20 is performed with the cover 20 being open. In this case, the sheet 100 is accordion-fold long tag paper on which a plurality of marks (black marks) for positioning is previously printed at regular intervals.

As illustrated in FIGS. 2 and 3, the main body 10 is provided with a platen roller 13, an automatic cutter unit 14, and a sheet insertion guide 15.

The platen roller 13 is rotatably held in the main body 10. The platen roller 13 faces the thermal head 21 to press the sheet 100 from the underneath relative to the thermal head 21. The sheet 100 is thereby sandwiched by the thermal head 21 and the platen roller 13 when printing. When the platen roller 13 rotates with the sheet 100 being sandwiched between the thermal head 21 and the platen roller 13, the sheet 100 is transported.

The automatic cutter unit 14 is disposed between the platen roller 13 and the sheet discharging opening 12*b*, and cuts the sheet 100 transported from the platen roller 13 in a predetermined position.

The sheet insertion guide 15 is a tapered frame, and regulates the feeding position of the sheet 100 by inserting the tapered end into the sheet feeding opening 12*a*.

As illustrated in FIG. 3, the thermal head 21 is provided inside the cover 20 to face the platen roller 13 in the main body 10. An operation unit 22 including a plurality of operation buttons 22*a* and a liquid crystal display screen 22*b* is provided in a front surface of the cover 20 (see FIG. 1). The thermal head 21 is a printing head including small heating elements arranged in a line, and prints characters or pictures on the sheet 100 by heating the heating elements according to data. The sheet 100 reacts by heat. The thermal head 21 and the platen roller 13 configure a printing mechanism of printing on the sheet 100. Note that the printing mechanism of the Embodiment includes a transport operation as the sheet 100 is transported by the rotation of the platen roller 13.

A sheet detection device 30 that detects a predetermined position of the sheet 100 is installed in the printer 1. Note that "predetermined position of sheet 100" is a position of a positioning mark which is previously printed on the sheet 100. The sheet detection device 30 is disposed between the sheet feeding opening 12*a* and the printing mechanism configured by the platen roller 13 and the thermal head 21.

Detailed Configuration of Sheet Detection Device

Figure 5:
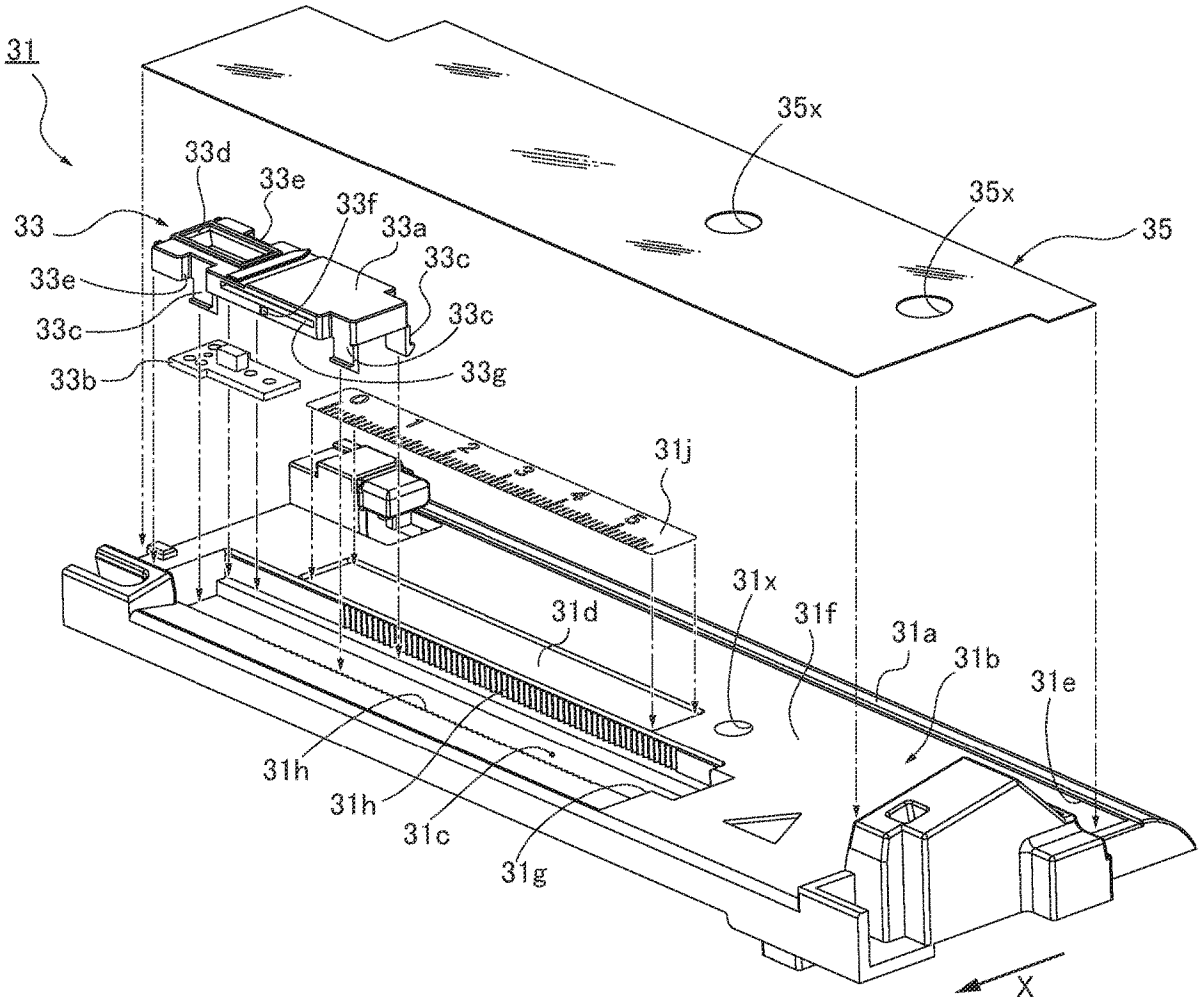
FIG. 5 is an exploded perspective view of a lower sheet guide of a sheet detection device according to the Embodiment.
Figure 6:
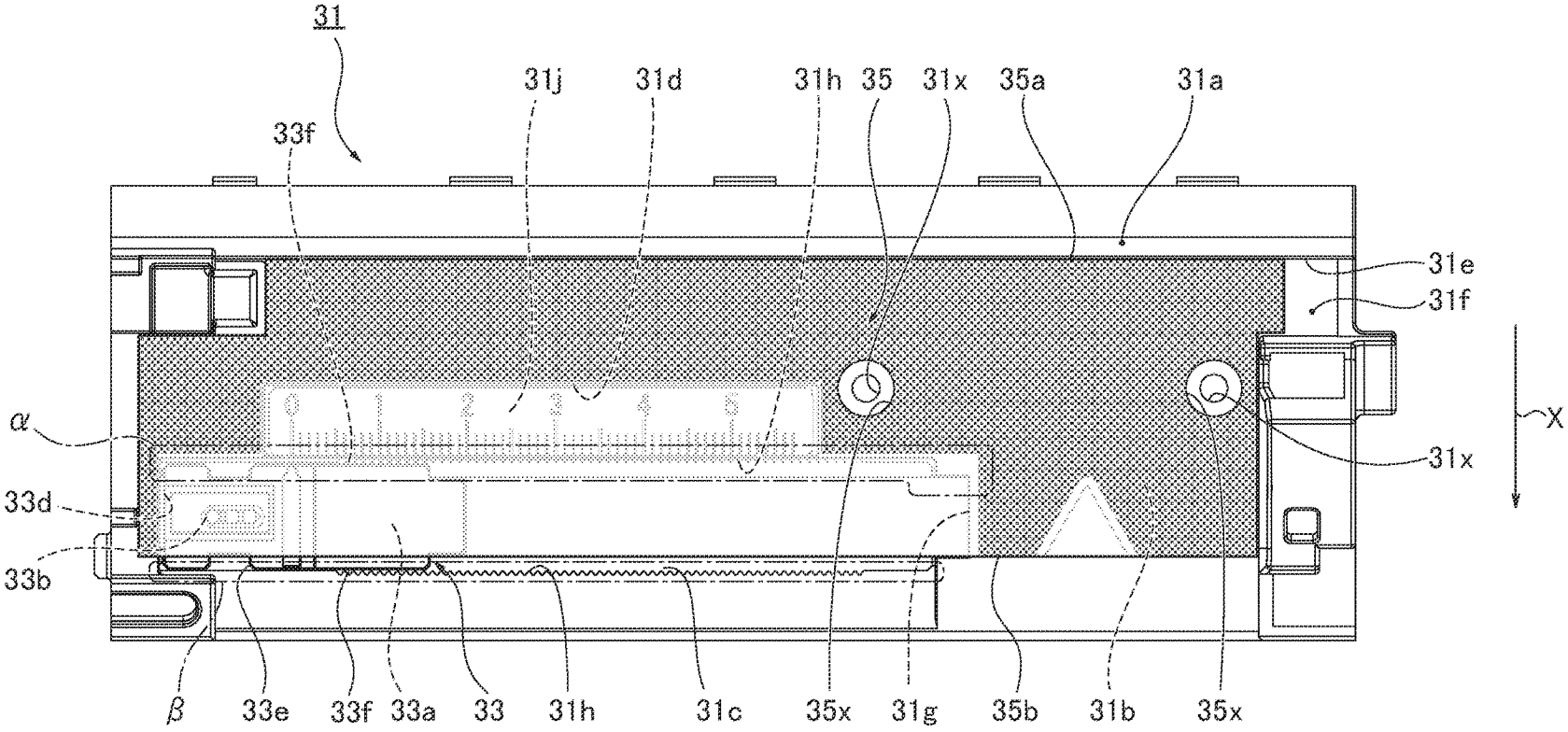
FIG. 6 is a plan view of the lower sheet guide of the sheet detection device according to the Embodiment.
Figure 7:
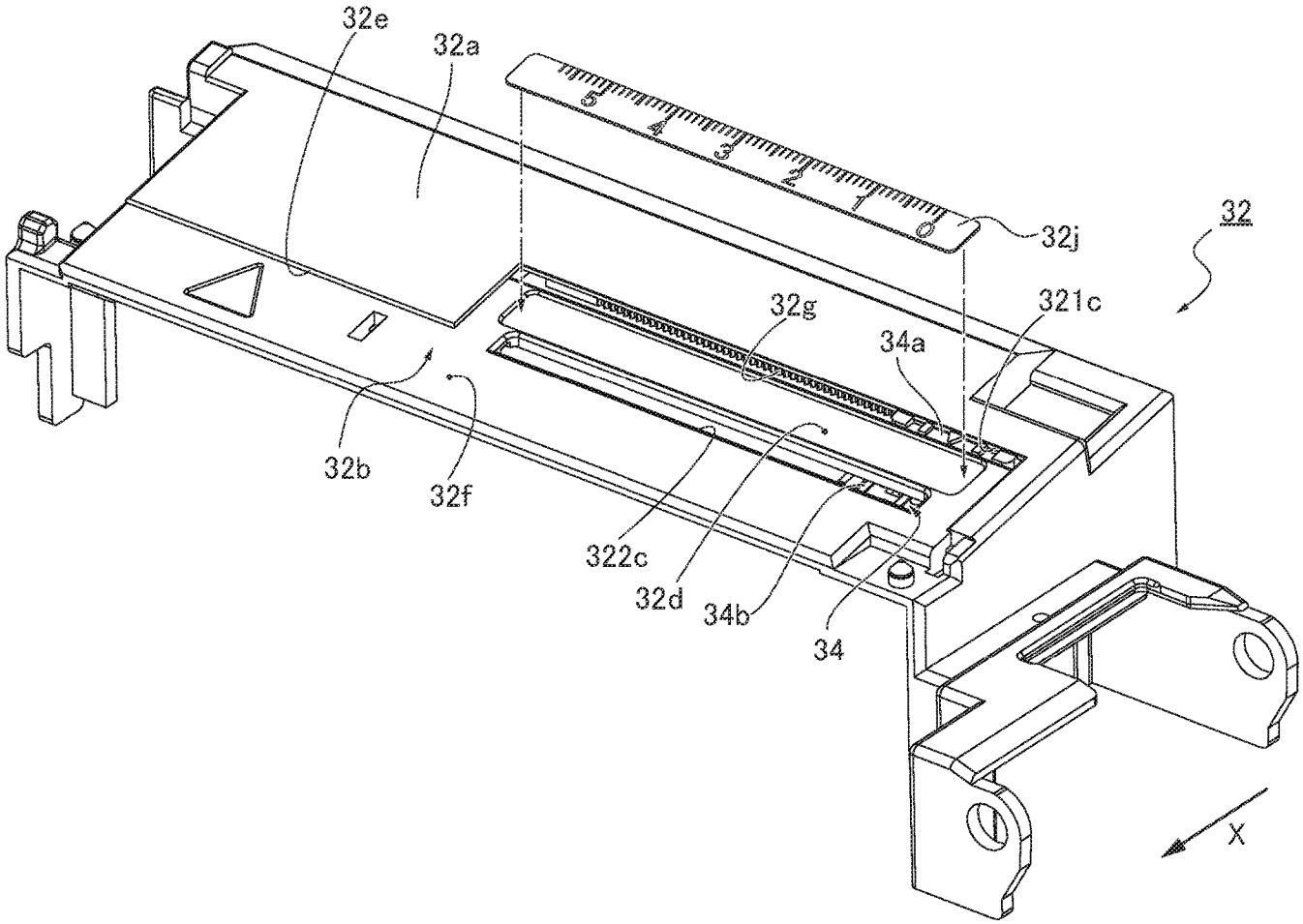
FIG. 7 is a perspective view of an upper sheet guide of the sheet detection device according to the Embodiment.
Figure 8:
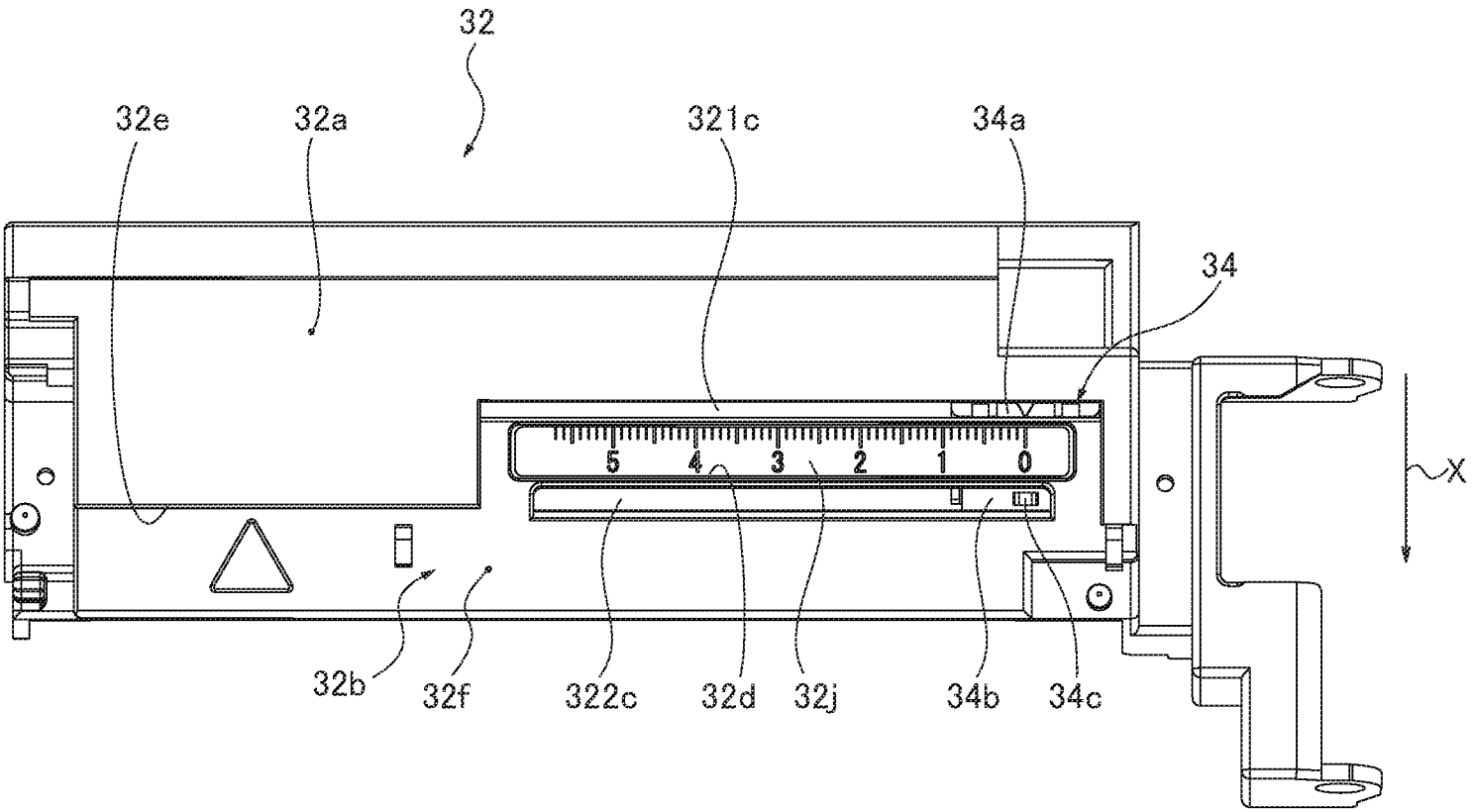
FIG. 8 is a plan view of the upper sheet guide of the sheet detection device according to the Embodiment.
Figure 9:
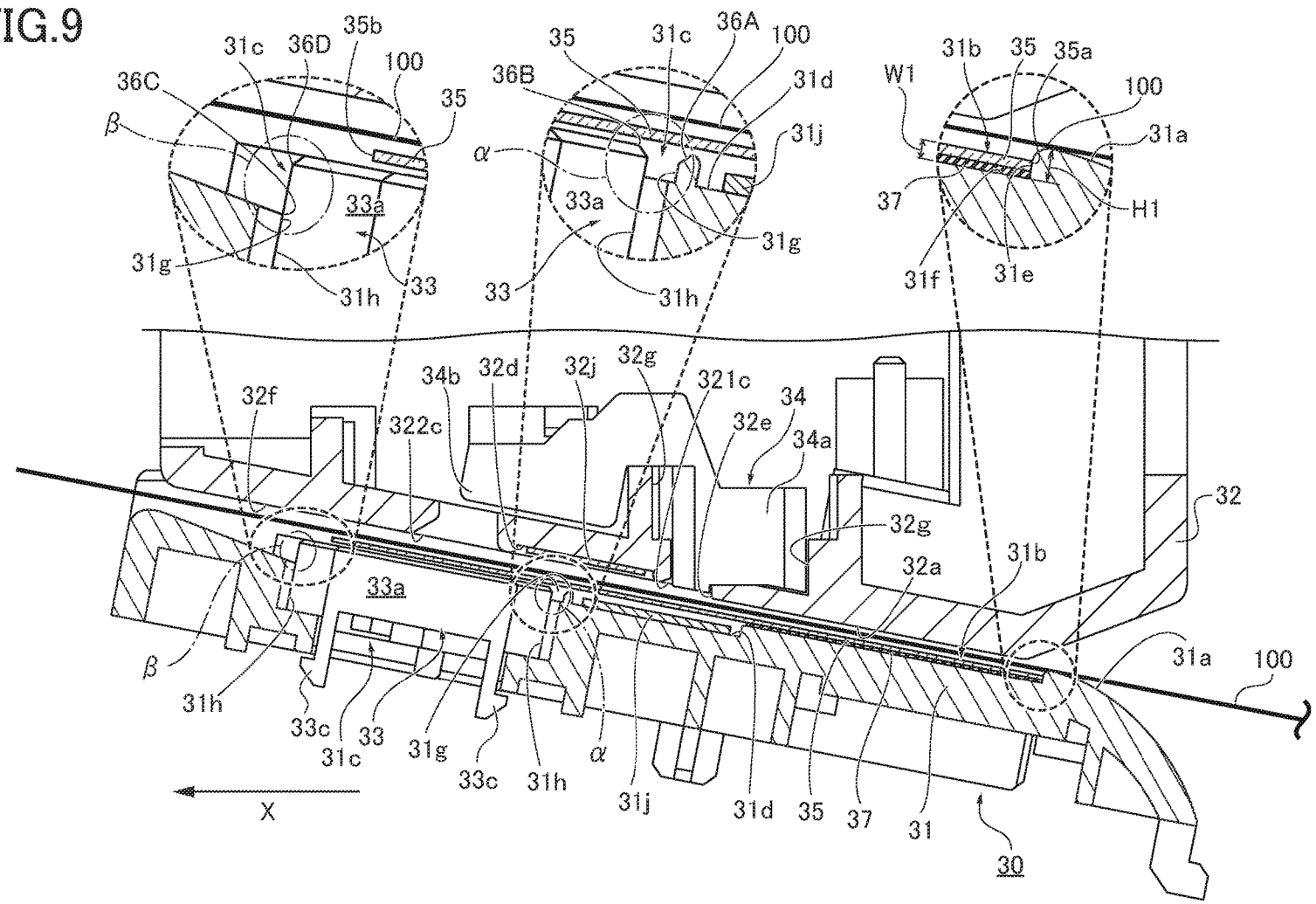
FIG. 9 is an enlarged view of a main portion of FIG. 4 including the lower sheet guide and the upper sheet guide of the sheet detection device according to the Embodiment.

FIGS. 5, 6 illustrate a lower sheet guide of the sheet detection device according to the Embodiment. FIGS. 7, 8 illustrate an upper sheet guide of the sheet detection device according to the Embodiment. FIG. 9 is an enlarged view of a main portion of FIG. 4 including the lower sheet guide and the upper sheet guide of the sheet detection device according to the Embodiment. Hereinafter, the detailed configurations of the sheet detection device according to the Embodiment are described with reference to FIGS. 5 to 9.

The sheet detection device 30 includes a lower sheet guide 31 (sheet guide), an upper sheet guide 32 (sheet guide), a lower sheet detection unit 33 (sheet detector), an upper sheet detection unit 34 (sheet detector), and a guide cover 35.

The lower sheet guide 31 is disposed in an upper portion of the main body 10, and has a lower guide surface 31*a* facing a rear surface of the sheet 100. The sheet 100 passes above the lower guide surface 31*a* (see FIG. 9). As illustrated in FIG. 5, a lower recess 31*b* (recess), a slot 31*c*, a dent 31*d* for a scale, and a hole 31*x* for a set screw are formed in the lower guide surface 31*a* of the lower sheet guide 31.

The lower recess 31*b* is zoned by a step 31*e* formed in the lower guide surface 31*a*, and is a region lower than the lower guide surface 31*a* on an upstream side of the step 31*e* in the sheet transport direction X. As enlarged in FIG. 9, the step 31*e* has a height H1 greater than a thickness of the guide cover 35 (in this case, the total thickness W1 of the thickness of the guide cover 35 and the thickness of a double-faced tape 37). Namely, the depth of the lower recess 31*b* which is determined by the height H1 of the step 31*e* is greater than the thickness of the guide cover 35. The lower recess 31*b* includes a recess surface 31*f* with the step 31*e* as a border.

The slot 31*c* penetrates through the lower recess 31*b*, and linearly extends along a direction orthogonal to the sheet transport direction X. An opening of the slot 31*c* on the lower guide surface 31*a* is defined as an opening 31*g* (lower opening) through which the after-described first optical sensor 33*b* of the lower sheet detection unit 33 is exposed. A wave portion 31*h* having an irregularity along the extending direction of the slot 31*c* is formed in both inner surfaces of the slot 31*c* extending in the direction orthogonal to the sheet transport direction X. The wave portion 31*h* includes convex portions each projecting in the sheet transport direction X and concave portions. The convex portions and the concave portions are alternately arranged (see FIG. 6).

The dent 31*d* for a scale is formed in the lower recess 31*b* by further denting the recess surface 31*f*. The dent 31*d* for a scale is positioned between the step 31*e* and the slot 31*c*, and is adjacent to an end portion 36A of the opening 31*g* on the upstream side in the sheet transport direction X in the Embodiment. The dent 31*d* for a scale linearly extends along the direction orthogonal to the sheet transport direction X. A scale sheet 31*j* (scale display) is stuck inside the dent 31*d* for a scale.

The hole 31*x* for a set screw is a hole through which a not-shown set screw for fixing the lower sheet guide 31 to the main body 10 penetrates. The hole 31*x* for a set screw is formed in an appropriate position of the lower guide surface 31*a*.

The upper sheet guide 32 is provided inside the cover 20, and includes an upper guide surface 32*a* facing the top surface of the sheet 100. The sheet 100 passes under the upper guide surface 32*a* (see FIG. 9). As illustrated in FIG. 7, an upper recess 32*b*, a first slot 321*c*, a second slot 322*c* (upper opening), and a dent 32*d* for a scale are formed in the upper guide surface 32*a* of the upper sheet guide 32.

The upper recess 32*b* is zoned by a step 32*e* formed in the upper guide surface 32*a*, and is a region lower than the upper guide surface 32*a* on the upstream side of the step 32*e* in the sheet transport direction X. The upper recess 32*b* includes a recess surface 32*f* with the step 32*e* as a border.

The first slot 321*c* penetrates through the upper recess 32*b*, and linearly extends along the direction orthogonal to the sheet transport direction X. An end portion of the first slot 321*c* on the upstream side in the sheet transport direction X is configured by a part of the step 32*e*. As illustrated in FIG. 9, a pair of wave wall surfaces 32*g*, 32*g* is formed in the rear surface of the upper sheet guide 32 (the surface opposite to the upper guide surface 32*a*). A pair of wave wall surfaces 32*g*, 32*g* faces each other across the first slot 321*c*.

A pair of wave wall surfaces 32*g*, 32*g* includes on the facing surfaces concave portions and convex portions alternately arranged along the extending direction of the first slot 321*c* (see FIG. 7).

The second slot 322*c* penetrates through the upper recess 32*b*, and linearly extends along the direction orthogonal to the sheet transport direction X. The second slot 322*c* is positioned on the downstream side of the first slot 321*c* in the sheet transport direction X.

The dent 32*d* for a scale is formed in the upper recess 32*b* by further denting the recess surface 32*f*. The dent 32*d* for a scale is positioned between the first slot 321*c* and the second slot 322*c*. The dent 32*d* for a scale linearly extends along the direction orthogonal to the sheet transport direction X, and a scale sheet 32*j* is stuck inside the dent 32*d* for a scale.

The lower sheet detection unit 33 is disposed inside the slot 31*c* formed in the lower guide surface 31*a* of the lower sheet guide 31, and includes a base 33*a* and the first optical sensor 33*b* (lower sensor).

The base 33*a* is a hollow casing having an open bottom, and includes a plurality of claws 33*c* each projecting downwardly. Each of the claws 33*c* penetrates through the slot 31*c*. The leading ends of the claws 33*c* engage with the rear surface of the lower sheet guide 31 (the surface opposite to the lower guide surface 31*a*) (see FIG. 9). The width of the base 33*a* in the direction along the sheet transport direction X is set slightly smaller than the width of the slot 31*c*. The base 33*a* is movable along the extending direction of the slot 31*c*. A window 33*d* is formed in the top surface of the base 33*a*. The first optical sensor 33*b* is fixed inside the window 33*d* to be exposed from the window 33*d*. A dent 33*e* for movement, a projection 33*f*, and a cutout 33*g* are formed in both sides of the base 33*a* facing the wave portions 31*h*. Note that the end portion 36A of the opening 31*g* of the slot 31*c* on the upstream side in the sheet transport direction X is set to a height such that the top surface of the base 33*a* disposed inside the slot 31*c* does not project from the end portion 36A.

As illustrated in FIG. 6, the projections 33*f* of the base 33*a* engage with the concave portions of the wave portions 31*h*, so that the base 33*a* is positioned in the movement direction (the direction orthogonal to the sheet transport direction X). When the force in the direction orthogonal to the sheet transport direction X is applied to the dent 33*e* for movement, the sides of the base 33*a* having stiffness lowered by the cutouts 33*g* elastically deform inwardly, and the projections 33*f* move over the convex portions of the wave portions 31*h*. The base 33*a* therefore becomes movable along the extending direction of the slot 31*c*.

The first optical sensor 33*b* includes a light emitting element, a first light receiving element, and an optical sensor circuit. The first optical sensor 33*b* is fixed inside the base 33*a* with the light emitting element and the first light receiving element facing the upper sheet detection unit 34. The light emitting element and the first light receiving element face the window 33*d*.

The upper sheet detection unit 34 is disposed on the rear surface of the upper sheet guide 32, and is movable along the first and second slots 321*c*, 322*c*. The upper sheet detection unit 34 includes an adjustor 34*a* facing the first slot 321*c* and a sensor 34*b* facing the second slot 322*c*.

The adjustor 34*a* is disposed between a pair of wave wall surfaces 32*g*, 32*g* of the upper sheet guide 32. A projection engaging with the concave portion of the wave wall surface 32*g* is formed in the adjustor 34*a*. The adjustor 34*a* includes an irregular surface facing the first slot 321*c*. When force in the direction orthogonal to the sheet transport direction X is applied to the irregular surface, the projection formed in the adjustor 34*a* moves over the convex portion of the wave wall surface 32*g*. The upper sheet detection unit 34 therefore moves along the first slot 321*c*. A second optical sensor 34*c* (upper sensor) configured by a second light receiving element is attached on the sensor 34*b*. The second optical sensor 34*c* moves along the extending direction of the second slot 322*c* along the movement of the adjustor 34*a*. The second slot 322*c* faces the movement region of the first optical sensor 33*b* of the lower sheet detection unit 33. The position of the second optical sensor 34*c* in the movement direction is appropriately adjusted relative to the position of the first optical sensor 33*b* in the movement direction to face the first optical sensor 33*b* and the second optical sensor 34*c* to each other.

The guide cover 35 is made of a colorless and transparent acrylic flat plate. The guide cover 35 is stuck inside the lower recess 31*b* formed in the lower guide surface 31*a* of the lower sheet guide 31 by the double-faced tape 37 (see FIG. 9). The adhesion region with the double-faced tape 37 is a region illustrated by dots in FIG. 6, and does not interfere with, for example, the opening 31*g*, the dent 31*d* for a scale, and the hole 31*x* for a set screw. In this case, an opening 35*x* through which the hole 31*x* for a set screw is exposed is formed in the guide cover 35.

As illustrated in FIG. 6, the guide cover 35 covers a part of the lower guide surface 31*a* from the step 31*e* to the position just in front of a second border position β between the lower sheet detection unit 33 and the opening 31*g* on the downstream side in the sheet transport direction X. Namely, an end portion 35*a* of the guide cover 35 on the upstream side in the sheet transport direction X abuts on the step 31*e* and an end portion 35*b* of the guide cover 35 on the downstream side in the sheet transport direction X is positioned above the slot 31*c*. The scale sheet 31*j* stuck inside the dent 31*d* for a scale and a first border position α between the lower sheet detection unit 33 and the opening 31*g* on the upstream side in the sheet transport direction X are thereby covered by the guide cover 35.

In this case, as enlarged in FIG. 9, "the first border position α between the lower sheet detection unit 33 and the opening 31*g* on the upstream side in the sheet transport direction X" is a portion between the end portion 36A of the opening 31*g* on the upstream side in the sheet transport direction X and the region in which the end 36B of the base 33*a* of the lower sheet detection unit 33 on the upstream side in the sheet transport direction X moves. The end portion 36A of the opening 31*g* on the upstream side in the sheet transport direction X is completely covered by the guide cover 35 by covering the first border position α with the guide cover 35. The region in which the end 36B of the base 33*a* of the lower sheet detection unit 33 on the upstream side in the sheet transport direction X moves is completely covered by the guide cover 35.

As enlarged in FIG. 9, "the second border position β between the lower sheet detection unit 33 and the opening 31*g* on the downstream side in the sheet transport direction X" is a portion between the end portion 36C of the opening 31*g* on the downstream side in the sheet transport direction X and the region in which the end 36D of the base 33*a* of the lower sheet detection unit 33 on the downstream side in the sheet transport direction X moves. The guide cover 35 covers a part of the lower guide surface 31*a* on the upstream side of the second border position β, so that the end 36D of the base 33*a* on the downstream side in the sheet transport direction X is exposed between the guide cover 35 and the opening 31*g*, and it becomes possible to press the dent 33*e* for movement formed in the base 33*a*.

As illustrated in FIG. 9, in the Embodiment, the opening 31*g* of the slot 31*c* has the end portion 36C on the downstream side in the sheet transport direction X lower than the end portion 35*b* of the guide cover 35 on the downstream side in the sheet transport direction X.

Next, the operations of the sheet detection device 30 and the printer 1 according to the Embodiment are described.

When the printer 1 according to the Embodiment is used, the sheet 100 is set. The sheet 100 is set with so-called autoloading. Namely, the leading end of the long sheet 100 is manually inserted into the sheet feeding opening 12*a* with the cover 20 being closed (as illustrated FIG. 1). The sheet 100 is manually fed until the leading end of the sheet 100 reaches a position between the platen roller 13 and the thermal head 21. When the leading end of the sheet 100 reaches the position between the platen roller 13 and the thermal head 21, the platen roller 13 rotates, and the sheet 100 is transported to a printable position by the transport force with the platen roller 13 and the thermal head 21. The sheet 100 is completely set by the autoloading of the sheet 100.

When the sheet 100 is fed until the leading end of the sheet 100 reaches the position between the platen roller 13 and the thermal head 21, it is necessary for the leading end of the sheet 100 to pass through the space between the lower sheet guide 31 and the upper sheet guide 32 of the sheet detection device 30 installed in the printer 1. The leading end of the sheet 100 is pulled downwardly by its own weight, and is fed while abutting on the lower sheet guide 31.

On the other hand, in the sheet detection device 30 according to the Embodiment, the guide cover 35 is stuck on the lower guide surface 31*a* of the lower sheet guide 31 by the double-faced tape 37. The guide cover 35 covers a part of the lower guide surface 31*a* from the step 31*e* formed in the lower guide surface 31*a* to the position just in front of the second boundary position β between the lower sheet detection unit 33 and the opening 31*g* on the downstream side in the sheet transport direction X.

The guide cover 35 is made of a flat acrylic plate although the opening 35*x* through which the hole 31*x* for a set screw is exposed is formed in the guide cover 35. Namely, the dent 31*d* for a scale formed in the lower guide surface 31*a* and the first border position α between the lower sheet detection unit 33 and the opening 31*g* on the upstream side in the sheet transport direction X are covered by the flat surface to form the flat surface above the first border position α, for example.

With this, when the leading end of the sheet 100 is fed inside the printer 1, the sheet 100 can be smoothly fed without being caught on the way to the position between the platen roller 13 and the thermal head 21 even if the sheet 100 abuts on the lower sheet guide 31. Moreover, as the guide cover 35 is transparent, the first optical sensor 33*b* of the lower sheet detection unit 33 disposed inside the slot 31*c* is not disturbed.

More specifically, in the sheet detection device 30, it is necessary to expose the first optical sensor 33*b* of the lower sheet detection unit 33 provided in the lower guide surface 31*a* so as to satisfy the operation (an operation of detecting a predetermined position of the sheet 100) as the sheet detection device 30. In order to expose the first optical sensor 33*b*, it is necessary to have the opening 31*g* of the slot 31*c* formed in the lower sheet guide 31. Namely, the generation of the irregularity due to the formation of the opening 31*g* of the slot 31*c* in the lower guide surface 31*a* is unavoidable in the sheet detection device 30.

However, by covering the first border position α between the lower sheet detection unit 33 and the opening 31*g* on the upstream side in the sheet transport direction X with the transparent guide cover 35 as the Embodiment, the flat surface is formed above the first border position α without disturbing the operation of the lower sheet detection unit 33. As a result, the sheet 100 inserted from the sheet feeding opening 12*a* with the cover 20 being closed smoothly reaches the printing mechanism (the position between the platen roller 13 and the thermal head 21) without being caught on the way to the printing mechanism.

In the Embodiment, the lower recess 31*b* having the depth H1 greater than the thickness W1 of the guide cover 35 is formed in the lower guide surface 31*a*, and the guide cover 35 is provided inside the lower recess 31*b*. Therefore, the lower guide surface 31*a* on the upstream side in the sheet transport direction X has a height higher than that of the guide cover 35, so that the end portion 35*a* of the guide cover 35 on the upstream side in the sheet transport direction X does not project from the step 31*e*. When the sheet 100 is fed inside the printer 1, the sheet 100 can be smoothly fed without being caught by the guide cover 35 even if the leading end of the sheet 100 is pulled downwardly by its own weight.

In the Embodiment, the end portion 35*a* of the guide cover 35 on the upstream side in the sheet transport direction X abuts on the step 31*e*. Therefore, no space is formed between the step 31*e* and the end portion 35*a*. The leading end of the sheet 100 is thus prevented from being caught in the space between the step 31*e* and the end portion 35*a*.

In the Embodiment, the opening 31*g* of the slot 31*c* extends in the direction orthogonal to the sheet transport direction X, and the lower sheet detection unit 33 disposed inside the slot 31*c* is provided to be movable along the extending direction of the opening 31*g*. The guide cover 35 covers a part of the lower guide surface 31*a* on the upstream side of the second border position β between the lower sheet detection unit 33 and the opening 31*g* on the downstream side in the sheet transport direction X. Namely, the second border position β is exposed without being covered by the guide cover 35 (see in FIG. 9).

The end 36D of the base 33*a* of the lower sheet detection unit 33 on the downstream side in the sheet transport direction X is exposed between the guide cover 35 and the end portion 36C of the opening 31*g* on the downstream side in the sheet transport direction X. Therefore, for example, a thin stick is inserted between the guide cover 35 and the end portion 36C, and the dent 33*e* for movement formed in the base 33*a* can be pressed by the thin stick. The lower sheet detection unit 33 can be thus moved along the extending direction of the opening 31*g*.

On the other hand, the opening 31*g* has the end portion 36C on the downstream side in the sheet transport direction X lower than the end portion 35*b* of the guide cover 35 on the downstream side in the sheet transport direction X. Namely, the irregularity on the lower guide surface 31*a* is lowered from the upstream to the downstream in the sheet transport direction X. With this, the sheet 100 is hardly caught by the end portion 36C of the opening 31*g* on the downstream side in the sheet transport direction X even if the leading end of the sheet 100 is pulled downwardly by its own weight when the sheet 100 is fed inside the printer 1. Thus, the sheet 100 can be smoothly transported.

In the Embodiment, the dent 31*d* for a scale is formed in the lower guide surface 31*a* and the scale sheet 31*j* is stuck inside the dent 31*d* for a scale. The position of the lower sheet detection unit 33 in the movement direction can be obtained by the scale in the scale sheet 31*j*, and the positional relationship with the upper sheet detection unit 34 can be appropriately adjusted.

In the Embodiment, the scale sheet 31*j* is covered by the guide cover 35, as illustrated in FIG. 9, and the flat surface is formed above the scale sheet 31*j*. Therefore, the sheet 100 can be prevented from being caught when the sheet 100 is fed inside the printer 1 while the position of the lower sheet detection unit 33 in the movable direction is obtained.

In the Embodiment, the guide cover 35 is provided in the lower sheet guide 31 to form the flat lower guide surface. With this, the sheet 100 can be prevented from being caught and can be smoothly transported even if the leading end of the sheet 100 is pulled downwardly by its own weight and the sheet 100 is fed while abutting on the lower sheet guide 31. According to the Embodiment, the sheet 100 inserted from the sheet feeding opening with the cover being closed can smoothly reaches the printing mechanism.

Modified Example

The Embodiment shows an example in which the guide cover 35 is provided in the lower guide surface 31*a* of the lower sheet guide 31 in the sheet detection device 30. However, it is not limited thereto. The guide cover may be provided in the upper guide surface 32*a* of the upper sheet guide 32, and the border position between the opening of the second slot 322*c* and the second optical sensor 34*c* on the upstream side in the sheet transport direction may be covered by the guide cover. In this case, the first slot 321*c* to which the adjustor 34*a* of the upper sheet detection unit 34 faces is disposed on the downstream side of the second slot 322*c* in the sheet transport direction, so that the upper sheet detection unit 34 can be moved.

The guide cover may be provided only in the lower guide surface 31*a* as the Embodiment, the guide cover may be provided in both the lower guide surface 31*a* and the upper guide surface 32*a*, or the guide cover may be provided only in the upper guide surface 32*a*. Such a configuration can be appropriately selected based on the shape of the sheet 100, the direction of the curl when the sheet 100 is roll paper, and the level and the condition of the caught sheet 100 which varies according to, for example, the weight, the thickness, and the hardness of the sheet 100, so as to prevent the sheet 100 from being caught.

The Embodiment shows an example in which the guide cover 35 is fixed by the double-faced tape 37. However, it is not limited thereto. For example, a claw that holds the guide cover 35 may be provided in the lower guide surface 31*a*, and the guide cover 35 is fixed by this claw.

The Embodiment shows an example in which the guide cover 35 is made of the colorless and transparent acrylic plate. However, the guide cover 35 may be made of a color plate as long as it has translucency and does not disturb the operation of the first optical sensor 33*b* and the second optical sensor 34*c*.

The Embodiment shows an example in which the printer 1 according to the present invention is a thermal printer. However, the printer according to the present invention is not limited to the thermal printer. Various types of printers such as an ink jet printer or a dot printer may be applied to the printer according to the present invention.

As described above, although the paper detection device and the printer according to the present invention are described based on the Embodiment, the specific configurations are not limited to the Embodiment. It should be appreciated that, for example, variations in design and addition may be included in the present invention without departing from the scope of the present invention according to each claim.

What is claimed is:

1. A sheet detection device comprising:

a sheet guide between a sheet feeding opening into which a sheet is to be inserted and a printing mechanism for printing on the sheet, the sheet guide including a guide surface through which the sheet is to pass;

a sheet detector including an optical sensor configured to detect a predetermined position of the sheet;

an opening defined in the guide surface, the sheet detector being inside the opening and the optical sensor being exposed through the opening; and a transparent guide cover positioned in the guide surface to cover at least a first border position between the sheet detector and the opening on an upstream side in a sheet transport direction.

2. The sheet detection device according to claim 1, wherein:

a recess having a depth greater than a thickness of the transparent guide cover is defined in the guide surface, and the transparent guide cover is inside the recess.

3. The sheet detection device according to claim 1, wherein:

the opening extends in a direction orthogonal to the sheet transport direction, the sheet detector is configured to be movable along an extending direction of the opening, the transparent guide cover covers a part of the guide surface on an upstream side of a second border position between the sheet detector and the opening on a downstream side in the sheet transport direction, and the opening has an end portion on the downstream side in the sheet transport direction, the end portion being lower than an end portion of the transparent guide cover on the downstream side in the sheet transport direction.

4. The sheet detection device according to claim 1, wherein:

the sheet guide includes a lower sheet guide configured to face a rear surface of the sheet and an upper sheet guide configured to face a top surface of the sheet, the optical sensor includes a lower sensor exposed by a lower opening defined in the lower sheet guide and an upper sensor exposed by an upper opening defined in the upper sheet guide, and the transparent guide cover is in at least one of the lower sheet guide and the upper sheet guide.

5. A printer comprising the sheet detection device according to claim 1.

6. A sheet detection device comprising:

a sheet guide between a sheet feeding opening into which a sheet is to be inserted and a printing mechanism for printing on the sheet, the sheet guide including a guide surface through which the sheet is to pass;

a sheet detector including an optical sensor configured to detect a predetermined position of the sheet;

an opening defined in the guide surface, the sheet detector being inside the opening and the optical sensor being exposed through the opening; and a transparent guide cover positioned in the guide surface to cover at least a first border position between the sheet detector and the opening on an upstream side in a sheet transport direction, wherein:

the opening extends in a direction orthogonal to the sheet transport direction, the sheet detector is configured to be movable along an extending direction of the opening, the guide surface is configured with a scale display on an upstream side of the first border position in the sheet transport direction, the scale display being configured to indicate a position of the optical sensor in a movement direction, and the scale display is covered by the transparent guide cover.

* * * * *